US011350721B2

(12) United States Patent
Williams-Sterling

(10) Patent No.: US 11,350,721 B2
(45) Date of Patent: Jun. 7, 2022

(54) HAIR DRYING SYSTEM

(71) Applicant: Sterling Hair Solutions, Long Beach, CA (US)

(72) Inventor: Jody Abram Williams-Sterling, Long Beach, CA (US)

(73) Assignee: Sterling Hair Solutions, Long Beach, CA (US)

( * ) Notice: Subject to any disclaimer, the term of this patent is extended or adjusted under 35 U.S.C. 154(b) by 79 days.

(21) Appl. No.: 16/865,765

(22) Filed: May 4, 2020

(65) Prior Publication Data

US 2020/0367629 A1 Nov. 26, 2020

Related U.S. Application Data

(60) Provisional application No. 62/852,201, filed on May 23, 2019.

(51) Int. Cl.
*A45D 20/14* (2006.01)
*A45D 20/52* (2006.01)

(52) U.S. Cl.
CPC ..... *A45D 20/14* (2013.01); *A45D 20/52* (2013.01)

(58) Field of Classification Search
CPC ..... A45D 20/14; A45D 29/52
USPC ..... 34/95–100
See application file for complete search history.

(56) References Cited

U.S. PATENT DOCUMENTS 931,881 A * 8/1909 Marr ..... A45D 20/18 34/99
1,431,943 A * 10/1922 Gee ..... A45D 20/52 132/114
1,852,933 A * 4/1932 Maier ..... A45D 4/12 132/228
2,189,430 A * 2/1940 McClure ..... A45D 20/46 34/283
2,224,876 A * 12/1940 Matys ..... A45D 4/10 34/100
2,278,112 A * 3/1942 Matys ..... A45D 20/46 34/100
2,335,553 A * 11/1943 Valverde ..... A45D 20/46 34/557
2,430,751 A * 11/1947 Woodyard ..... A45D 4/10 34/97
3,044,183 A * 7/1962 Mauch ..... A45D 20/18 34/99
3,113,848 A * 12/1963 Clark, Jr. ..... A45D 20/18 34/99

(Continued)

*Primary Examiner* — Stephen M Gravini
(74) *Attorney, Agent, or Firm* — Perkins Coie LLP; Brian R. Coleman

(57) ABSTRACT

The present embodiments relate to a hair drying system that allows for proper drying of hair and a scalp of a user underneath hair or hair accessories (e.g., hair extensions) to avoid or minimize scalp damage, mold or mildew and to ensure that the hair dries properly. The hair drying system can include several flexible tubes that delivers air through the holes of the tubes. The tubes can be secured on the head of a wearer such that the air is directed to underneath the hair extensions or any other portion of the head where the wearer intends to dry the hair. The hair drying system can be portable, making it easy for users to carry the hair drying system anywhere, and can be mounted on a height adjustable stand for ease of use.

20 Claims, 7 Drawing Sheets

(56) References Cited

U.S. PATENT DOCUMENTS

| | | | | | |
|---|---|---|---|---|---|
| 3,313,036 | A * | 4/1967 | Fortune | A45D 20/24 | 34/99 |
| 4,121,353 | A * | 10/1978 | Baumgartner | A45D 20/18 | 34/99 |
| 4,692,594 | A * | 9/1987 | Martin | A45D 20/12 | 132/112 |
| 4,766,914 | A * | 8/1988 | Briggs | A45D 20/00 | 132/212 |
| 5,120,304 | A * | 6/1992 | Sasaki | A61M 1/85 | 604/35 |
| 5,621,980 | A * | 4/1997 | Kingsbury | A45D 20/122 | 132/114 |
| 5,970,622 | A * | 10/1999 | Bahman | A45D 20/00 | 34/97 |
| 10,674,806 | B1 * | 6/2020 | Hammond | A45D 2/001 | |
| 10,791,814 | B2 * | 10/2020 | Masterson | A45D 20/12 | |
| 10,993,518 | B2 * | 5/2021 | Chang | A45D 20/22 | |
| 2017/0231359 | A1 * | 8/2017 | Taylor | A45D 20/12 | 34/99 |
| 2020/0367629 | A1 * | 11/2020 | Williams-Sterling | A45D 20/52 | |

* cited by examiner

HAIR DRYING SYSTEM

CROSS REFERENCE TO RELATED APPLICATIONS

The present application claims priority to U.S. Provisional Patent Application No. 62/852,201, titled "HAIR DRYING SYSTEM," and filed May 23, 2019, which is incorporated by reference in its entirety hereto.

TECHNICAL FIELD

The present embodiments relate to a hair drying system and, more particularly, to a hair drying system including a structure to dry hair and a scalp of a user underneath the hair.

BACKGROUND

Various hair accessories are used by users to adorn the human hair in order to enhance one's beauty. One example hair accessory are hair extensions that can be attached to natural hair of a user (or simply "wearer"). The hair extensions can provide the appearance of thick hair, long hair, or to provide varied colorations that are distinct from the natural human hair on the head of a wearer.

Any of a variety of temporary or semi-permanent attachment techniques can be used to attach hair extensions to natural hair. Example attachment techniques can include clip-ins, tape-ins, weaves, pre-bonded, fusion, micro-link, etc. These techniques can be implemented when attaching hair extensions to natural hair.

Further, it is generally desirable to maintain the attachment of the hair extensions to natural hair over a time period. However, various challenges may be present when maintaining the attachment of the hair extensions to natural hair.

Some types of hair extensions can be easily detached from the natural hair every time the wearer washes the natural hair and the hair extension back after the natural hair is dry. However, for some types of hair extensions, such as weaves that are sewn into the natural hair, additional care may be necessary in maintaining the hair extensions, as they may not be removed from the head as easily and often as other temporary hair extension attachment methods.

In many cases, hair extensions are washed with the human hair. After washing and/or shampooing the hair extensions, the wearer may have the challenge of ensuring that their natural hair underneath the hair extensions or hair weave completely dries. If the hair underneath does not dry properly, it can lead to hair damage, mold, mildew, and irritation to the scalp, and can create an unpleasant mildew odor.

DETAILED DESCRIPTION

The present embodiments relate to a hair drying system that increases efficiency in drying a scalp, hair extensions, and/or natural hair underneath hair damage. The present hair drying system can allow for proper drying of the natural hair underneath the hair extensions to mitigate risks of incidence of scalp damage, mold and/or mildew, and that the hair dries properly for optimal natural hair health.

The hair drying system as described herein can include a series of flexible tubes with a set of holes formed therein. Air can then flow through the tubes and escape via the set of holes. The tubes can be disposed near or on the head of a wearer such that air blowing from the set of holes can be distributed across the head, scalp, natural hair, and/or hair extensions of the wearer.

For example, the natural hair of a wearer is braided to hair extensions (which may be referred to as a "hair weave"). The tubes of the present hair drying system can be secured to the natural hair and/or hair extensions via a securing mechanism disposed on the tubes. The tubes can be attached to a main body of the hair drying system that directs the air through the tubes. By directing the air to intended places underneath the hair weave, the hair drier system can ensure that the natural hair/scalp dries adequately and also cut down the drying time (e.g., cuts a typical hair drying time in half).

Figure 1:
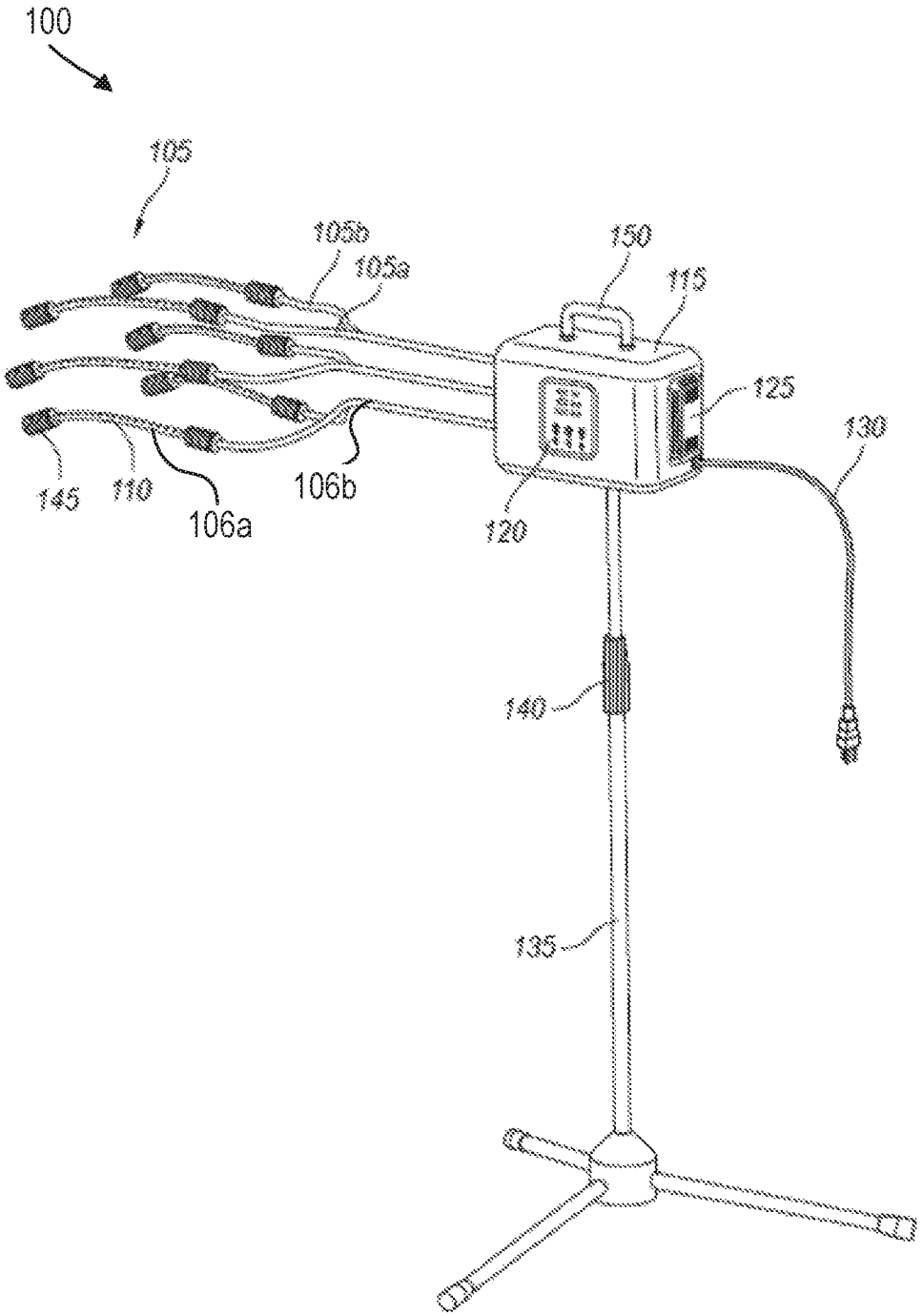
FIG. 1 illustrates an example hair drying system, consistent with various embodiments.

FIG. 1 illustrates an example hair drying system 100, consistent with various embodiments. As noted above, hair drying system 100 can be used to accelerate a hair drying process for a consumer (e.g., a wearer of hair extensions).

In some embodiments, the hair extensions are sewn to a portion of natural hair of the wearer that is braided. The hair drying system 100 can accelerate drying of the natural hair that is underneath the hair extensions.

While the following paragraphs describe the use of the hair drying system 100 by consumers who wear hair extensions, the use of the hair drying system 100 is not restricted to such consumers and can be used by any consumer, (e.g., consumers not wearing the hair extensions). The hair drying system 100 can cut down the drying time of the hair significantly while also drying hair and the scalp of the wearer in a uniform manner.

The hair drying system 100 can include a set of tubes 105 configured to engage with a main body 115. The set of tubes 105 can be configured to be disposed around a head of a user. For instance, three tubes 105 can be included in the set of tubes, where each tube can fork/divide into multiple tubes (e.g., 105*a*, 105*b*) capable of disposing around a head of the user.

The set of tubes 105 can comprise flexible tubes with a set of holes/outlets 110 formed therein. The holes 110 can be evenly disposed along portions of the tubes 105 such that air can escape the tubes 105 via holes 110. The tubes 105 can be positioned on the head of the wearer such that the air blown out of at least some of the holes 110 is directed to a portion of the natural hair underneath the hair extensions. By directing the air to the natural hair underneath the hair extensions, the hair drying system 100 can ensure that the natural hair underneath the hair extensions dries properly. In some embodiments, the hair drying system 100 cuts the drying time significantly (e.g., in half) compared to the other hair drying processes.

The main body 115 can engage with the set of tubes 105 and can distribute air to tubes 105. For example, the main body 115 can include a fan (not illustrated) that can draw the air from an air vent 125 and blow it into the tubes 105. The hair drying system 100 can blow cool air or hot air. For example, the main body 115 can include a heating element (not illustrated), and the fan can force air through the heating element to blow warm air. The temperature of the air can be regulated. For example, the main body 115 includes a control panel 120 having controls for adjusting the temperature of the heating element. By adjusting the temperature of the heating element, the temperature of the air forced through the heating element also changes accordingly. The control panel 120 can also provide various other functions, such as setting a duration for which the hair drying system 100 has to run (e.g., continue to blow the air), setting a speed of the fan, which controls the speed at which the air is delivered out of the tubes 105, and selecting the number of tubes 105 that delivers the air. The control panel 120 can also display information such as fan speed, air temperature, duration for which the hair drying system 100 has been running, remaining duration, etc. In some embodiments, the control panel 120 is a touchscreen interface, which can display information and accept commands (such as the ones described above). In some embodiments, the hair drying system 100 can be interfaced with a computing device, such as a smartphone, and can be controlled via the smartphone. For example, the wearer can use an app installed on the smartphone to perform various functions such as setting the temperature, drying time, fan speed, and number of tubes to be used. The wearer can also see at least a part of the information that is displayed on the control panel 120 in the smartphone. In some embodiments, the hair drying system 100 can be interfaced with the smartphone wirelessly, e.g., via Bluetooth.

In some embodiments, the main body 115 can be capable of outputting audio (e.g., music) or video, such that the wearer can listen to music while engaging with the hair drying system 100 via an audio component (e.g., speaker, headphone). The main body 115 can be in communication with a computing node capable of deriving appropriate audio content to output to the wearer. For instance, artificial intelligence or neural networks can be used to intelligently derive music/advertising content that is associated with a salon associated with the hair drying system 100 or content relating to relevant products to be presented to the wearer. In some instances, advertising can be provided to the wearer that is based on information specific to the wearer (e.g., internet browsing history, previous purchases by the wearer).

The main body 115 can include an air vent 125 for air intake, which can direct the air from outside of the main body 115 to the fan in the main body 115. The main body 115 can be connected to a power outlet via a power cord 130. In some embodiments, the power cord 130 is retractable and can retract into the main body 115. The main body 115 can be detachably mounted on a stand 135. Further, the stand 135 can be adjusted to different heights using a height adjustment mechanism such as an adjustment knob 140. The main body 115 can also include a carry handle 150 that can aid in carrying the hair drying system 100.

The tubes 105 can be detachably attached to the main body 115. The tubes 105 can be designed to have two portions (e.g., a left-side portion 105*a* and a right-side portion 105*b*). The left-side portion 105*a* can be secured on the left side of the head of the wearer and the right-side portion 105*b* can be secured on the right side of the head to uniformly dry the hair on both sides of the head. The number of tubes 105 on each side can vary (e.g., from 1 to 5 tubes) and the wearer will have the option to activate/deactivate one or more tubes 105 (e.g., select which of the tubes 105 delivers air). Each tube can vary in size and length. For example, a length of the tube can range from 8 inches to 24 inches and the diameter from ⅞th inch to ⅜th inch.

The tubes 105 can be secured on the head of wearer using grippers 145. The grippers 145 can be removably attached to the tubes 105 by inserting the tubes 105 through the grippers 145. Each of the tubes 105 can have one or more grippers 145. When the tubes 105 are laid out on the head under the hair extensions layer, the grippers 145 stick to the hair extensions and hold the tubes 105 in place, e.g., secured to the hair extensions, while drying the hair from the air blown out of the tubes 105. The grippers 145 can use any of a variety of engagement techniques, such as a hook and loop fastener, Velcro®, etc.

Figure 2:
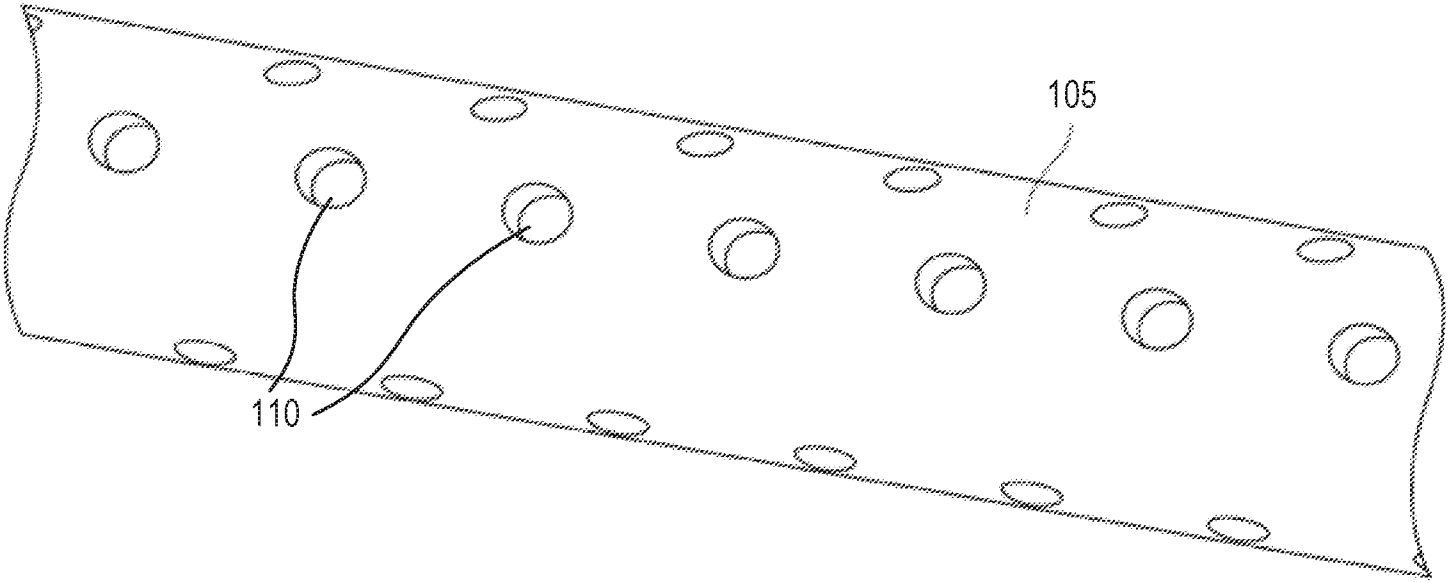
FIG. 2 is an illustration of an example tube, in accordance with various embodiments.

FIG. 2 is an illustration of an example tube 105, in accordance with various embodiments. As shown in FIG. 2, one tube 105 is depicted. While one tube 105 is described with respect to FIG. 2, any number of tubes may be part of a set of tubes. Each tube in the set of tubes can be disposed adjacent (or subjacent or superjacent) to one another.

Each tube in the set of tubes can include a first portion (e.g., 106*b*) and a second portion (e.g., 106*a*). The first portion (e.g., 106*b*) can include a portion of each tube capable of engaging with the main body 115. In some instances, the first portion (e.g., 106*b*) may not include any holes/openings along the tubes.

The second portion (e.g., 106*a*) of the tubes may be split or divided into sections. The sections included in the second portion (e.g., 106*a*) may include a series of holes and/or one or more grippers. The series of holes may be disposed along the tubes so as to evenly distribute air along the second portion (e.g., 106*a*) of the tubes.

As described in greater detail below, the tubes can include at least one gripper. As noted above, the gripper can be used to engage the tubes to hair, hair extensions, and/or the scalp of the wearer. In some embodiments, each tube can include multiple grippers to increase security of the engagement between the wearer and the tubes.

Figure 3:
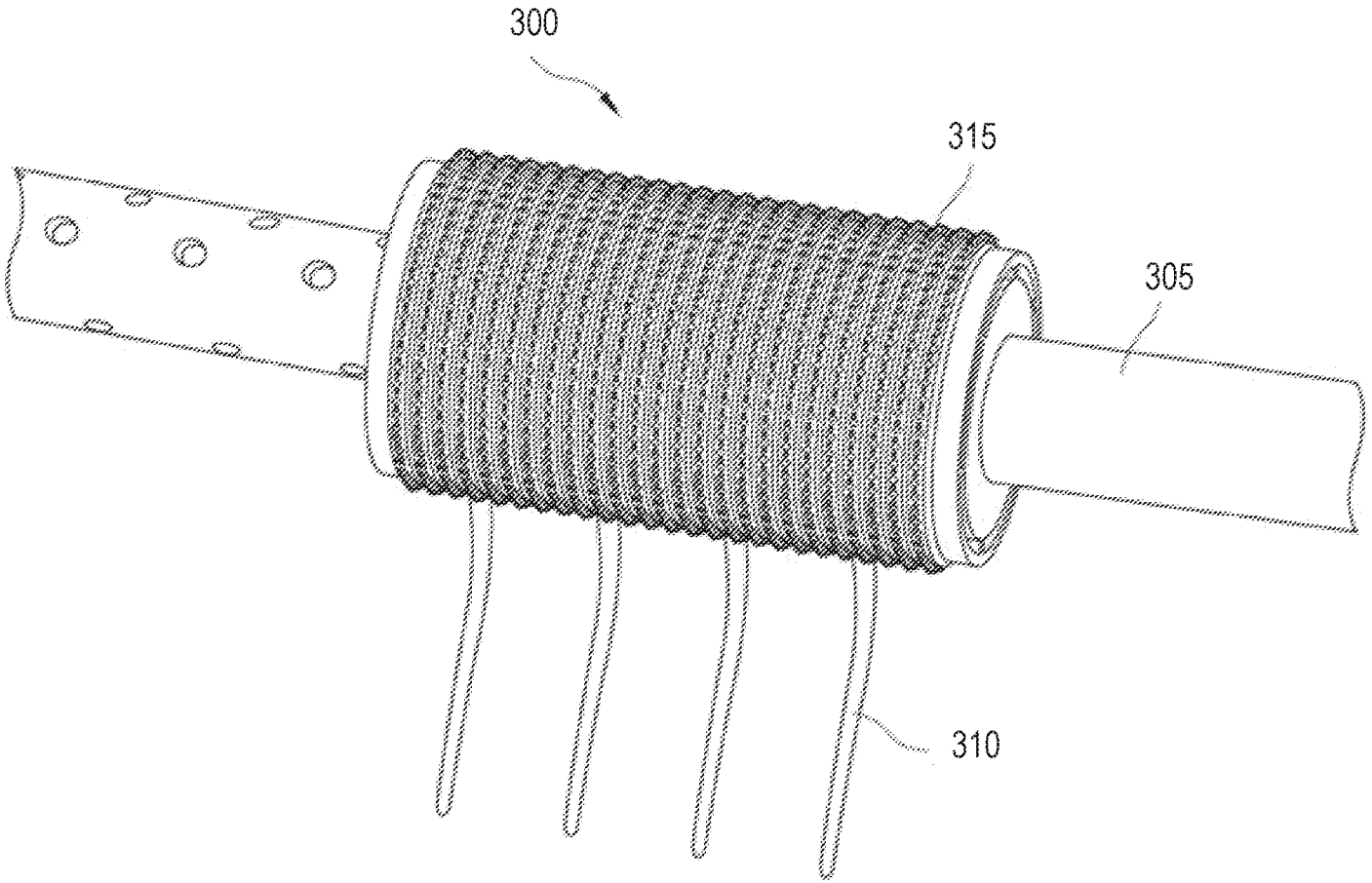
FIG. 3 illustrates an example gripper disposed around a tube, in accordance with various embodiments.

FIG. 3 illustrates an example gripper 300 disposed around a tube 305, in accordance with various embodiments. In some embodiments, the gripper 300 is similar to the grippers 145 as described with reference to FIG. 1. The gripper 300 may be attached to a tube 305, such as one of the tubes 105, by sliding the gripper 300 onto the tube 305. Multiple grippers can be attached to the tube 305. The gripper 300 may include hooks 315 to which the hair (e.g., from the hair extensions) stick, thereby securing the tube 305 in place. In some embodiments, the gripper 300 can also include a comb 310 (or comb like teeth) which can stick down into the hair extension, which would allow the tube 105 to extend off the head by approximately half an inch or less depending on how far the wearer adjusts the combing down into the braided hair or the hair. This can allow the air to shoot down into the direct area the wearer wants it to dry.

Figure 4:
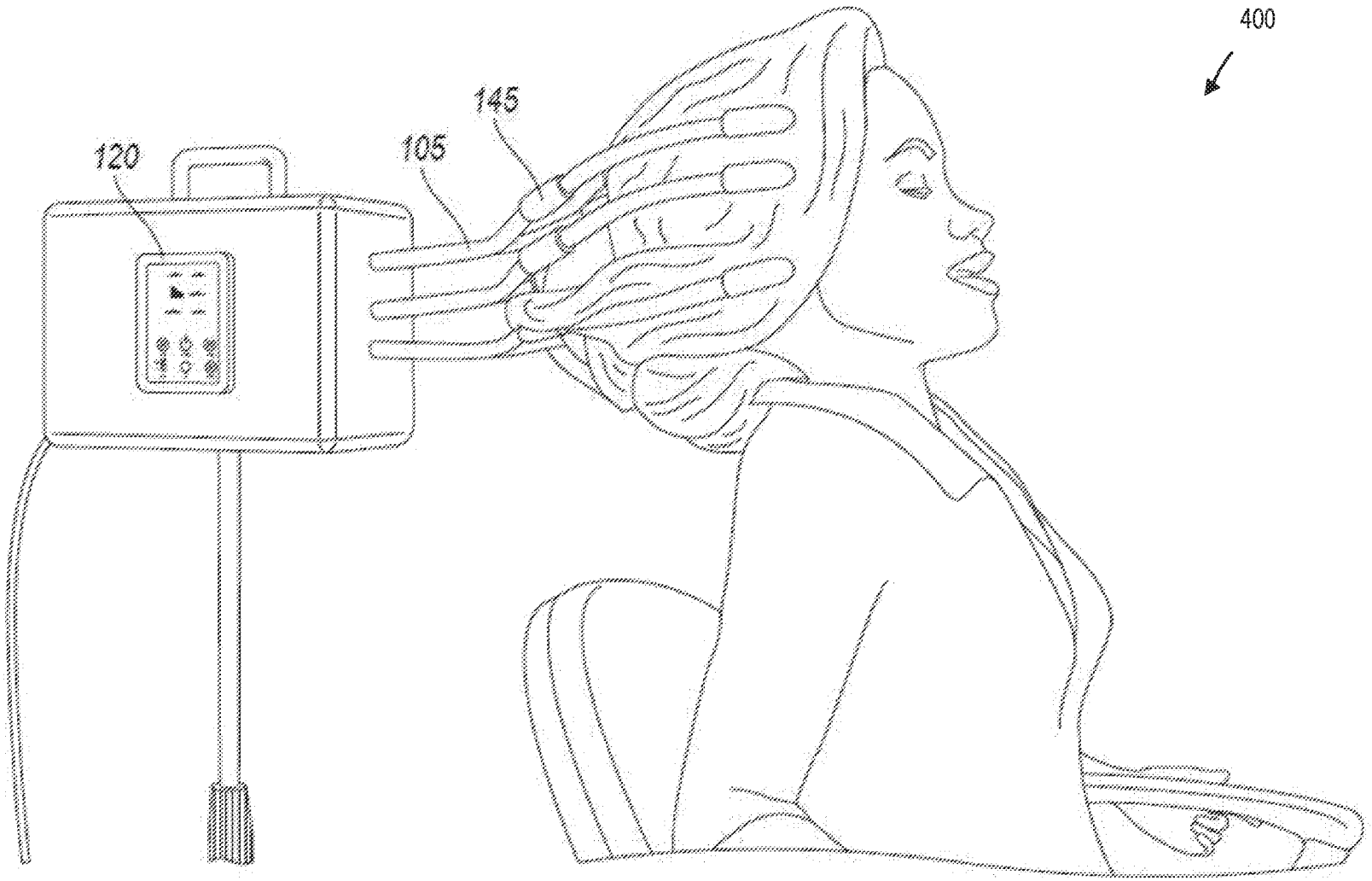
FIG. 4 is a block diagram of an example main body, in accordance with various embodiments.

FIG. 4 illustrates a hair drying system 400 in use by a consumer wearing hair extensions, consistent with various embodiments. The example as illustrated in FIG. 4 may not accurately depict the intended layout of the tubes on the wearer's head. However, the example can provide a general idea of how the hair drying system 100 can be used to dry the hair. The flexible tubes 105 can lay in between each layer that has braids of natural hair and the wafted hair extension. Typically, the hair extensions are attached to braided natural hair. For example, a first layer of natural hair is combed up and away from the scalp and clipped to the hair on the top of the head, then a small portion of a second layer of the natural hair is braided and then a first set of hair extensions is sewn to the braided hair. The above process can be repeated from multiple layers of hair extensions.

Typically, layers of hair extensions are sewn one above the other (e.g., starting from bottom of the head (e.g., near the neck)) and then moving towards the top of the head for a next layer. Continuing with the above example, to attach a second layer of hair extensions, a portion of the first layer may be let down freely to cover the portion where the first set of hair extensions is sewn to the second layer, then a portion of the hair above the second layer (e.g., towards the top of the head) is braided to form a third layer and a second set of hair extensions is sewn to the third layer and the remaining hair of the first layer is let down, which covers the third layer and also any remaining portion of the second layer. That is, the second set of hair extensions may be sewn to the hair above the hair to which the first set of hair extensions is sewn. There is a layer of natural hair between the second set of hair extensions and the first set of hair extensions and another layer under the first set of hair extensions, all of which need to be dried using the hair drying system 100.

The wearer, or a person assisting the wearer such as a hair stylist, can lay the individual tubes between each layer that needs drying, e.g., (a) between the second set of hair extensions and the first set of hair extensions and (b) under the first set of hair extensions, which need to be dried using the hair drying system 100. The wearer can have the choice to use grippers 145 with or without comb.

Further, the left-side portion of the tubes are positioned around the left side of the head and the right-side portion of the tubes are positioned around the right side of the head to assure drying of each side at the same time. The hair drying system 100 is then switched on, e.g., using the controls from the control panel 120 to start the drying process. The natural hair and/or the scalp (a) between the second set of hair extensions and the first set of hair extensions and (b) under the first set of hair extensions start to dry from the air blown out of the tubes 105.

Figure 5:
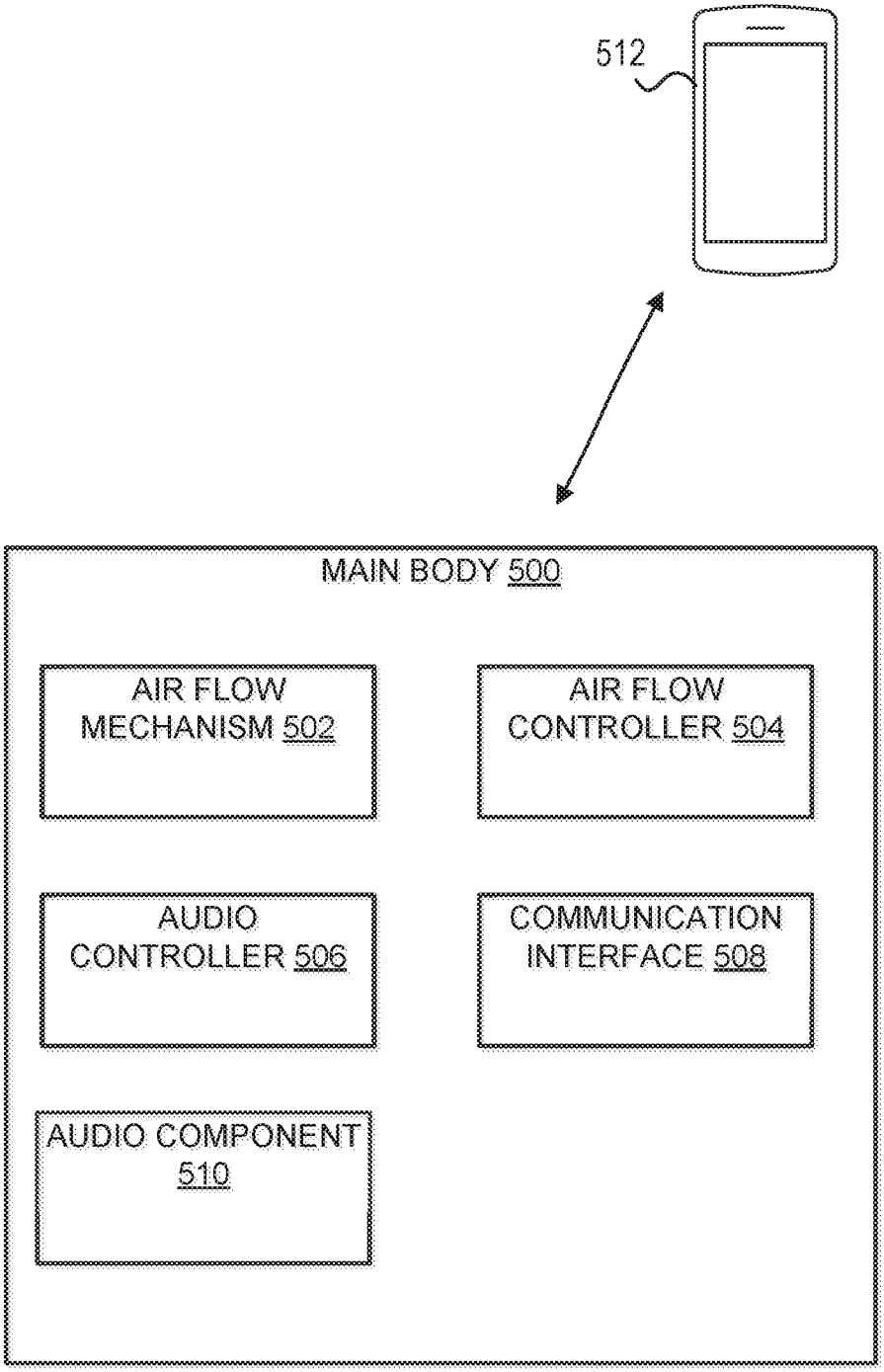
FIG. 5 is a block diagram of an example main body, in accordance with various embodiments.

FIG. 5 is a block diagram of an example main body 500, in accordance with various embodiments. As shown in FIG. 5, the main body 500 can include an air flow mechanism 502. The air flow mechanism 502 can include one or more components capable of modifying and/or directing a flow of air. An example air flow mechanism 502 can include a fan capable of intaking air and directing the air along an airflow. In some embodiments, the air flow mechanism 502 can include heating/cooling components to modify a temperature of the air flowing through the airflow.

The main body can include an air flow controller 504 capable of controlling settings of the air flow mechanism 502. For instance, the air flow controller 504 can modify the strength of air flow from the air flow mechanism 502 or modify a temperature of the air flowing through the airflow.

The main body 500 can include an audio controller 506. The audio controller 506 can control output of audio from an audio component 510 (e.g., a speaker). The audio content can include music or other audio specific to the operator of the hair drying system. For example, a salon that operates the hair drying system can control the content outputting form the audio component 510.

In some embodiments, the audio controller 506 can selectively deliver audio content to the user based on information specific to the user and/or information specific to the operator of the hair drying system. For instance, any of previous purchasing history of the user, web history of a mobile device of a user, preferences of a user, etc., can be used to selectively deliver content (e.g., advertising content) to the user.

The main body 500 can include a communication interface 508. The communication interface 508 can facilitate wireless and/or wired communication with another device (e.g., a mobile device associated with the user). For instance, a smartphone of a user can provide an instruction to modify settings of the air flow controller 504 via a short-range wireless communication (e.g., Bluetooth®). A mobile device can wirelessly operate and control settings of the main body 500 via communication interface 508.

The main body 500 can communicate with electronic device (e.g., smartphone 512) via communication interface 508. For example, the smartphone 512 can provide an instruction to modify settings of the air flow controller 504 via communication interface 508.

Figure 6:
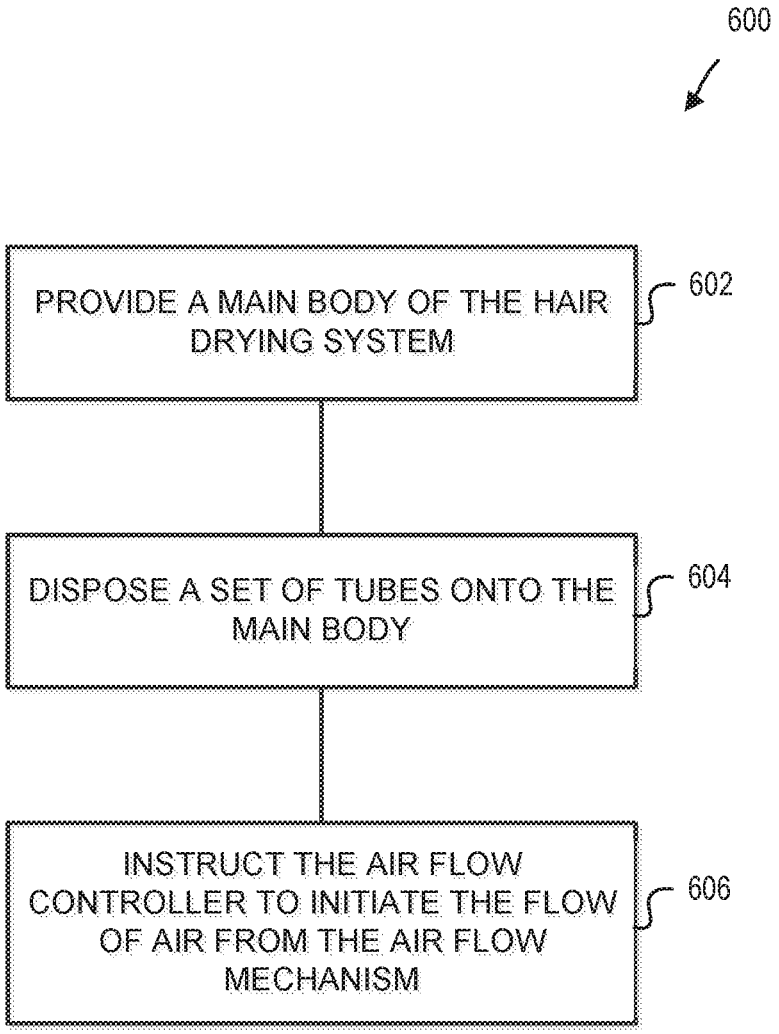
FIG. 6 is a block diagram of an example method for controlling a flow of air through a hair drying system, in accordance with various embodiments.

FIG. 6 is a block diagram of an example method 600 for controlling a flow of air through a hair drying system, in accordance with various embodiments. The method can include providing a main body of the hair drying system (block 602). The main body can include an air flow mechanism capable of directing the flow of air and an air flow controller to control the flow of air from the air flow mechanism.

The method can include disposing a set of tubes onto the main body (block 604). The set of tubes may be configured to engage with the main body and to be disposed around a head of a user. Each tube of the set of tubes can include a series of openings formed along a first portion of each tube and a gripping mechanism disposed along the first portion of each tube.

The method can also include instructing the air flow controller to initiate the flow of air from the air flow mechanism (block 606). The airflow may be directed from the air flow mechanism to the series of openings via each tube of the set of tubes.

In some embodiments, the method can include engaging the set of tubes to any of the head of the user, a portion of hair of the user, and a hair accessory of the user via the gripping mechanism of each tube of the set of tubes. The gripping mechanism can include a series of hook fasteners disposed along the gripping mechanism and a series of comb teeth extending from the gripping mechanism.

In some embodiments, the method can include receiving a short-range wireless message from a mobile device via a communication interface of the main body. The short-range wireless message can provide an instruction to modify the direction of the air flow mechanism. The air flow controller can be configured to modify the air flow mechanism based on information included in the short-range wireless message.

In some embodiments, the method can include outputting audio content from an audio component of the main body. Outputting audio content from an audio component of the main body can include controlling the output the audio content from the audio component via an audio controller of the main body. The control of the audio content may be based on any of information relating to an operator of the hair drying system and information relating to characteristics of the user.

Processing System

Figure 7:
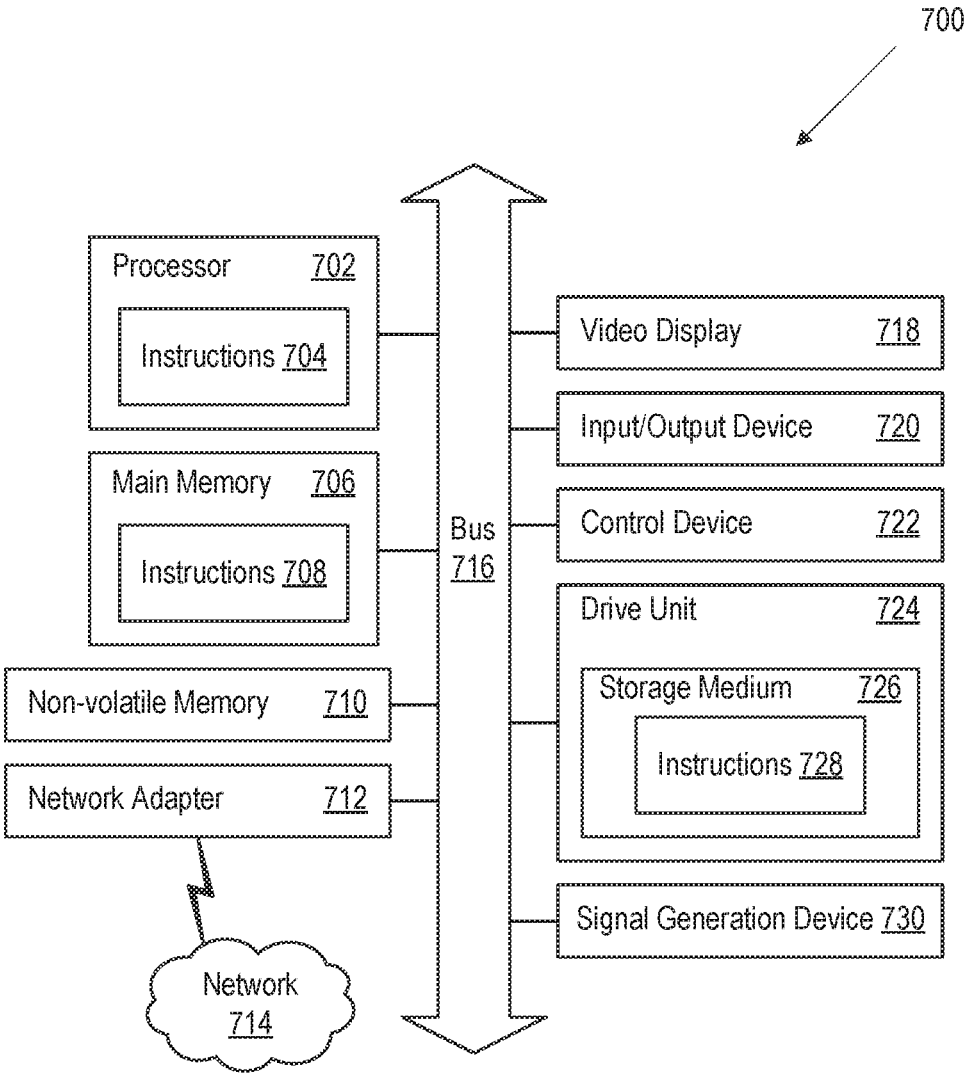
FIG. 7 is a block diagram illustrating an example of a processing system in which at least some operations described herein can be implemented.

FIG. 7 is a block diagram illustrating an example of a processing system in which at least some operations described herein can be implemented. For example, some components of the processing system 700 can be hosted on an electronic device as described in the present embodiments.

The processing system 700 can include one or more central processing units ("processors") 702, main memory 706, non-volatile memory 710, network adapter 712 (e.g., network interface), video display 718, input/output devices 720, control device 722 (e.g., keyboard and pointing devices), drive unit 724 including a storage medium 726, and signal generation device 730 that are communicatively connected to a bus 716. The bus 716 is illustrated as an abstraction that represents one or more physical buses and/or point-to-point connections that are connected by appropriate bridges, adapters, or controllers. The bus 716, therefore, can include a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus (i.e., "Firewire").

The processing system 700 can share a similar computer processor architecture as that of a desktop computer, tablet computer, personal digital assistant (PDA), smartphone, game console, music player, wearable electronic device (e.g., a watch or fitness tracker), network-connected ("smart") device (e.g., a television or home assistant device), virtual/augmented reality systems (e.g., a head-mounted display), or another electronic device capable of executing a set of instructions (sequential or otherwise) that specify action(s) to be taken by the processing system 700.

While the main memory 706, non-volatile memory 710, and storage medium 726 (also called a "machine-readable medium") are shown to be a single medium, the term "machine-readable medium" and "storage medium" should be taken to include a single medium or multiple media (e.g., a centralized/distributed database and/or associated caches and servers) that store one or more sets of instructions 728. The term "machine-readable medium" and "storage medium" shall also be taken to include any medium that is capable of storing, encoding, or carrying a set of instructions for execution by the processing system 700.

In general, the routines executed to implement the embodiments of the disclosure can be implemented as part of an operating system or a specific application, component, program, object, module, or sequence of instructions (collectively referred to as "computer programs"). The computer programs typically comprise one or more instructions (e.g., instructions 704, 708, 728) set at various times in various memory and storage devices in a computing device. When read and executed by the one or more processors 702, the instruction(s) cause the processing system 700 to perform operations to execute elements involving the various aspects of the disclosure.

Moreover, while embodiments have been described in the context of fully functioning computing devices, those skilled in the art will appreciate that the various embodiments are capable of being distributed as a program product in a variety of forms. The disclosure applies regardless of the particular type of machine or computer-readable media used to actually effect the distribution.

Further examples of machine-readable storage media, machine-readable media, or computer-readable media include recordable-type media such as volatile and non-volatile memory devices 710, floppy and other removable disks, hard disk drives, optical disks (e.g., Compact Disk Read-Only Memory (CD-ROMS), Digital Versatile Disks (DVDs)), and transmission-type media such as digital and analog communication links.

The network adapter 712 enables the processing system 700 to mediate data in a network 714 with an entity that is external to the processing system 700 through any communication protocol supported by the processing system 700 and the external entity. The network adapter 712 can include a network adaptor card, a wireless network interface card, a router, an access point, a wireless router, a switch, a multi-layer switch, a protocol converter, a gateway, a bridge, bridge router, a hub, a digital media receiver, and/or a repeater.

The network adapter 712 can include a firewall that governs and/or manages permission to access/proxy data in a computer network and tracks varying levels of trust between different machines and/or applications. The firewall can be any number of modules having any combination of hardware and/or software components able to enforce a predetermined set of access rights between a particular set of machines and applications, machines and machines, and/or applications and applications (e.g., to regulate the flow of traffic and resource sharing between these entities). The firewall can additionally manage and/or have access to an access control list that details permissions including the access and operation rights of an object by an individual, a machine, and/or an application, and the circumstances under which the permission rights stand.

The techniques introduced here can be implemented by programmable circuitry (e.g., one or more microprocessors), software and/or firmware, special-purpose hardwired (i.e., non-programmable) circuitry, or a combination of such forms. Special-purpose circuitry can be in the form of one or more application-specific integrated circuits (ASICs), programmable logic devices (PLDs), field-programmable gate arrays (FPGAs), etc.

Conclusion

Unless contrary to physical possibility, it is envisioned that (i) the methods/steps described above may be performed in any sequence and/or in any combination, and that (ii) the components of respective embodiments may be combined in any manner.

The techniques introduced above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), etc.

Software or firmware to implement the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible medium can include recordable/non-recordable media (e.g., read-only memory (ROM), random access memory (RAM), magnetic disk storage media, optical storage media, flash memory devices, etc.).

Any of the steps as described in any methods or flow processes herein can be performed in any order to the extent the steps in the methods or flow processes remain logical.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described but can be practiced with modification and alteration within the spirit and scope of the appended claims. Accordingly, the specification and drawings are to be regarded in an illustrative sense rather than a restrictive sense.

What is claimed is:

1. A hair drying system comprising:

a main body comprising an air flow mechanism capable of directing an airflow;

a set of flexible tubes coupled to the main body and configured to be disposed around a head of a user, each tube of the set of flexible tubes including a series of openings formed along a first portion of each tube, wherein each tube is configured to direct the airflow from the main body to the series of openings to uniformly distribute air along the first portion of each tube via the series of openings; and a gripping mechanism disposed along the first portion of each tube, the gripping mechanism removably attachable along a length of the first portion of each tube and configured to engage each tube to any of the head, a portion of hair of the user, or a hair accessory of the user.

2. The hair drying system of claim 1, wherein the set of flexible tubes includes three tubes, wherein each of the three tubes are disposed adjacent to one another along a vertical plane.

3. The hair drying system of claim 1, wherein each tube of the set of flexible tubes further includes:

two sections of the first portion of each tube that are connected by a fork dividing the first portion of each tube into the two sections, wherein each of the two sections includes the series of openings and the gripping mechanism; and a second portion with a first end including the fork dividing the first portion of each tube into the two sections.

4. The hair drying system of claim 1, wherein each tube of the set of flexible tubes further includes:

two gripping mechanisms disposed along the first portion of each tube, wherein the series of openings are disposed along the first portion of each tube between the two gripping mechanisms.

5. The hair drying system of claim 1, wherein the gripping mechanism along the first portion of each tube includes:

a series of hook fasteners disposed along the gripping mechanism; and a series of comb teeth extending from the gripping mechanism.

6. The hair drying system of claim 1, wherein the series of openings are disposed uniformly along the first portion of each tube.

7. The hair drying system of claim 1, the main body further including:

an air flow controller configured to modify the airflow from the air flow mechanism; and a communication interface facilitating short-range wireless communication with a mobile device, wherein the mobile device is capable of providing instructions to modify settings of the air flow controller via the communication interface.

8. The hair drying system of claim 1, the main body further including:

an audio controller configured to control an output of audio content from an audio component of the main body.

9. The hair drying system of claim 8, wherein the audio controller is configured to selectively output the audio content based on any of information relating to an operator of the hair drying system and information relating to characteristics of the user.

10. An apparatus comprising:

a main body comprising an air flow mechanism capable of directing an airflow; and a set of tubes coupled to the main body and configured to direct the airflow, each tube of the set of tubes including:

a first portion of each tube that includes two sections of the first portion of each tube that are connected by a fork dividing the first portion of each tube into the two sections, each of the two sections including a series of openings formed therein and a slidable gripping mechanism disposed around each of the two sections of the first portion of each tube, and a second portion of each tube including a first end dividing the first portion of each tube into the two sections and a second end configured to engage to the main body.

11. The apparatus of claim 10, wherein the set of tubes include three tubes, wherein each tube is disposed adjacent to one another along a vertical plane, wherein each of the three tubes are configured to dispose around a head of a user.

12. The apparatus of claim 10, wherein each tube of the set of tubes further includes:

two gripping mechanisms disposed along the first portion of each tube, each of the two gripping mechanisms configured to engage the set of tubes to any of a head of a user, a portion of hair of the user, and a hair accessory of the user, wherein the series of openings are disposed along the first portion of each tube between the two gripping mechanisms.

13. The apparatus of claim 10, wherein the slidable gripping mechanism along the first portion of each tube includes:

a series of hook fasteners disposed along the slidable gripping mechanism; and a series of comb teeth extending from the slidable gripping mechanism.

14. The apparatus of claim 10, the main body further including:

an air flow controller configured to modify the airflow from the air flow mechanism; and a communication interface facilitating short-range wireless communication with a mobile device, wherein the mobile device is capable of providing instructions to modify settings of the air flow controller via the communication interface.

15. The apparatus of claim 10, the main body further including:

an audio controller configured to control an output of audio content from an audio component of the main body, wherein the audio controller is configured to selectively output the audio content based on any of information relating to an operator of the apparatus and information relating to characteristics of a user.

16. A method for controlling a flow of air through a hair drying system, the method comprising:

providing a main body of the hair drying system, the main body including an air flow mechanism capable of directing the flow of air, and an air flow controller configured to control the flow of air from the air flow mechanism;

disposing a set of tubes onto the main body, the set of tubes configured to be disposed around a head of a user, each tube of the set of tubes including a series of openings formed along a first portion of each tube and a slidable gripping mechanism disposed along the first portion of each tube; and instructing the air flow controller to initiate the flow of air from the air flow mechanism, wherein the flow of air is directed from the air flow mechanism to the series of openings via each tube of the set of tubes.

17. The method of claim 16, further comprising:

engaging the set of tubes to any of the head of the user, a portion of hair of the user, and a hair accessory of the user via the slidable gripping mechanism of each tube of the set of tubes, wherein the slidable gripping mechanism includes a series of hook fasteners disposed along the slidable gripping mechanism and a series of comb teeth extending from the slidable gripping mechanism.

18. The method of claim 16, further comprising:

receiving a short-range wireless message from a mobile device via a communication interface of the main body, the short-range wireless message providing an instruction to modify a direction of the air flow mechanism, wherein the air flow controller is configured to modify the air flow mechanism based on information included in the short-range wireless message.

19. The method of claim 16, further comprising:

outputting audio content from an audio component of the main body.

20. The method of claim 19, further comprising:

controlling the output the audio content from the audio component via an audio controller of the main body, wherein the controlling of the audio content is based on any of information relating to an operator of the hair drying system and information relating to characteristics of the user.

* * * * *